United States Patent [19]

Laughlin et al.

[11] Patent Number: 4,470,454

[45] Date of Patent: Sep. 11, 1984

[54] PRIMARY SURFACE FOR COMPACT HEAT EXCHANGERS

[75] Inventors: Robert M. Laughlin, Kenmore, Wash.; Paul L. Hoffman, Stratford; John J. Martin, Milford, both of Conn.

[73] Assignee: Avco Corporation, Stratford, Conn.

[21] Appl. No.: 409,427

[22] Filed: Aug. 19, 1982

[51] Int. Cl.[3] ..... F28F 3/04; F28D 9/02

[52] U.S. Cl. ..... 165/166

[58] Field of Search ..... 165/166, 167

[56] References Cited

U.S. PATENT DOCUMENTS

| | | | |
|---|---|---|---|
| 2,596,642 | 5/1952 | Boestad | 165/166 |
| 2,940,736 | 6/1960 | Ödman | 165/166 |
| 3,165,152 | 1/1965 | Jones | 165/166 |
| 3,424,240 | 1/1969 | Stein et al. | 165/166 |
| 3,498,372 | 3/1970 | Patten et al. | 165/166 |
| 3,759,323 | 9/1973 | Dawson et al. | 165/166 |
| 3,783,090 | 1/1974 | Andersson et al. | 165/166 |
| 4,431,050 | 2/1984 | Martin | 165/166 |

FOREIGN PATENT DOCUMENTS

| | | | |
|---|---|---|---|
| 1486919 | 9/1977 | United Kingdom | 165/167 |
| 2091407 | 7/1982 | United Kingdom | 165/166 |

OTHER PUBLICATIONS

Compactness of Ground Turbine Depends on Integral Recuperator, Engel et al., Automotive Engineering, Aug. 1971, pp. 13–17, vol. 79, No. 8.

*Primary Examiner*—Sheldon J. Richter

*Attorney, Agent, or Firm*—Ralph D. Gelling

[57] ABSTRACT

A heat exchange apparatus is provided with a plurality of plates formed and stacked so at to provide heat transfer through the plates from a first gas to a second gas. The plates are of substantially identical configuration and size, each of the plates formed with a central opening and an alternating arrangement of first and second surface patterns, ports being provided between the first and second surface patterns. The plates are stacked such that adjacent plates are rotated 180° about a diametrical axis relative to each other and so as to place the ports and patterns in alignment, surface patterns of the first type from any of the plates being adjacent to surface patterns of the second type on a plate adjacent thereto to form a plurality of opposing pattern pairs. Each of the first and second patterns in each pattern pair have a plurality of sinusoidally varying surface strips and a plurality of spacing ridges between the surface strips whereby the second gas flows in a generally sinusoidal path in a first direction between the first and second plates and the first gas flows in a generally sinusoidal path in a direction opposite the second gas along the other sides of the first and second plates.

6 Claims, 11 Drawing Figures

PRIMARY SURFACE FOR COMPACT HEAT EXCHANGERS

The Government has rights in this invention pursuant to Contract No. DAAK30-78-C-0054 awarded by the Department of the Army.

BACKGROUND OF THE INVENTION

The present invention relates to a new and improved primary surface for use in a corrugated plate type heat exchanger, and more particularly a heat exchanger device made up of a plurality of identical plates of relatively thin material, so formed and stacked as to provide heat transfer through the plates to and from a series of alternate flow passages formed between the stacked, alternate plates.

U.S. Pat. No. 3,424,240 to Stein et al., assigned to the assignee of the present invention, discloses a heat exchanger device made up of a plurality of plates formed in two types of configurations stacked alternately in pairs to form the stack. The two types of plates have spaced openings therethrough which are aligned when stacked to form inlet and outlets to and from one of the series of longitudinal flow passages in the stacked plates. The first type of plates is preferrably formed with a pattern of corrugations between the spaced openings extending across the plates in a radially outward direction thus providing channel forming, generally parallel wave formations on both surfaces thereof. On the other hand, the other of the two types of plates is formed with a pattern of generally parallel corrugations extending circumferentially along the plates between the spaced openings therethrough, the pattern of corrugations on the second type of plates extending transversely to the corrugations provided on the first type of plates when the two different types of plates are positioned adjacent one another to form a construction pair with the spaced openings in alignment. The aligned openings in the first and second types of plates are sealed together by welding or brazing.

One of the drawbacks in making the plates is that it is necessary that two different sets of dies be utilized for forming the two different types of plates. In order to avoid this difficulty, a "Stacked-Plate Heat Exchanger made of Identical Corrugated Plates" is disclosed in co-pending U.S. patent application Ser. No. 312,309, filed Oct. 16, 1981, by John J. Martin, and assigned to the assignee of the present invention, the entire disclosure of which is hereby incorporated by reference. Disclosed therein is a corrugated stacked-plate heat exchanger which employs identical plates each of which is configured so as to include about the radially outer portion thereof an alternating arrangement of radially extending and transversely extending parallel corrugations. Since the plates are identical and of uniform thickness, the internal stresses in the structure due to the expansion and contraction of the metal plates during a wide range of temperature variations are limited. The resulting corrugated stacked-plate heat exchanger obviates the need for tubular inlet and outlet channels extending longitudinally through the stack and the necessity for connections and inlet and outlet openings from such tubes to and from the heat transfer channels in the stack. Furthermore, the provision of identical plates employed in the heat exchanger facilitates the assembly of the heat exchanger since only a single hydroform punch is required and die upkeep is thus minimized.

Continuous production of identical plates is available since the die does not have to be changed, as was required to manufacture the series one and series two plates in the heat exchanger of U.S. Pat. No. 3,424,240.

Although the use of the single type of plate in the above-mentioned Ser. No. 312,309 reduces construction costs and system complexity, many of the operating characteristics inherent in the prior heat exchangers, such as that disclosed in U.S. Pat. No. 3,424,240 are also inherent in the newer heat exchanger. When the first and second types of plates are placed adjacent each other, a grid of touching points is formed between each pair of adjacent plates by the intersection of the longitudinal and transverse ridges from the alternate plates. A plurality of flow passages through which a gas or air travels are established between the touching points on the grid. When so formed, however, a contraction and expansion of the flow passage at each transverse ridge is inherently produced, the flow passages varying in area along the direction of flow to thereby promote thermal mixing within the passages and enhance the rate of heat transfer.

However, by reducing the pressure losses associated with expanding and contracting passages, a primary surface heat exchanger may achieve a higher ratio of heat transfer parameter to friction factor.

SUMMARY OF THE INVENTION

It is therefore an object of the invention to provide an improved primary surface for compact heat exchangers which provides a reduced pressure drop between input port and output ports, and increases the rate of heat transfer.

It is a further object of the invention to provide a heat exchange apparatus which employs an improved primary surface through which heat is transferred, the improved primary surface reducing the pressure drop between input and output ports and increasing the rate of heat transfer.

In accordance with a first aspect of the invention, a heat exchange apparatus is made up of a plurality of plates formed and stacked as to provide heat transfer through the plates from a first gas to a second gas. The plates are of substantially identical configuration and size, each of the plates formed with a central opening and an alternating arrangement of first and second surface patterns. Ports are provided between the first and second surface patterns and the plates are stacked such that adjacent plates are rotated 180° about a diametrical axis relative to each other so as to place the ports and patterns in alignment. Surface patterns of the first type from any of the plates are adjacent to surface patterns of the second type on a plate adjacent thereto to form a plurality of abutting and opposing pattern pairs. Each of the first and second patterns in each pattern pair have a plurality of generally sinusoidally varying surface strips and a plurality of spacing ridges between the surface strips, whereby the second gas flows in a generally sinusoidal path in a first direction along a first side of the first and second plates between the first and second plates and the first gas flows in a generally sinusoidal path in a direction opposite the first direction along the other side of at least one of the first and second plates.

More specifically, the plurality of spacing ridges on the second pattern in each pattern pair are disposed relative to the plurality of spacing ridges on the first pattern such that the plurality of spacing ridges on the second pattern lie along a line substantially in the middle of the plurality of surface strips of the first pattern, and the plurality of spacing ridges on the first pattern lie alon; a line substantially in the middle of the surface strips of the second pattern. The first and second patterns in each pattern pair are provided with first and second sealing ridges disposed on opposite sides of the plurality of surface strips and substantially parallel to the spacing ridges. The first sealing ridges extend from one end of each of the first and second patterns and terminate short of the other end of the first and second patterns to provide an inlet for the second gas. The second sealing ridges extend from the other end of the first and second patterns and terminate short of the one end of the first and second patterns to provide an outlet for the second gas. The first and second sealing ridges on the first pattern abut the first and second sealing ridges on the second pattern, respectively, the second gas flowing from the inlet to the outlet between the first and second patterns.

Still more specifically, the first and second patterns in each pattern pair further include third and fourth sealing ridges disposed on opposite ends of the plurality of surface strips substantially perpendicular to the spacing ridges.

In accordance with a second aspect of the invention, a heat exchange apparatus is made up of a plurality of plates formed and stacked as to provide heat transfer through the plates from a first gas to a second gas, the plates being of substantially identical configuration and size. Each of the plates is formed with a central opening and an alternating arrangement of first and second surface patterns. Ports are provided between the first and second surface patterns and the plates are stacked such that adjacent plates are rotated 180° abut a diametrical axis relative to each other and so as to place the ports and patterns in alignment. The surface patterns of the first type from any of the plates are adjacent to surface patterns of the second type on a plate adjacent thereto to form a plurality of abutting and opposing pattern pairs. Each of the first and second patterns in each pattern pair have a generally sinusoidally varying surface and a grid of support points adapted to maintain the first and second patterns a predetermined distance from each other, whereby the second gas flows in a generally sinusoidal path in a first direction along a first side of the first and second patterns between the first and second pattern, and the first gas flows in a generally sinusoidal path in a direction opposite the first direction along the other side of at least one of the first and second patterns.

In accordance with a third aspect of the invention, a heat exchange apparatus is made up of a plurality of plates formed and stacked as to provide heat transfer through the plates from a first gas to a second gas. The plates are of substantially identical configuration and size, each of the plates formed with a central opening and an alternating arrangement of first and second surface patterns. Ports are provided between the first and second surface patterns and the plates are stacked such that adjacent plates are rotated 180° about a diametrical axis relative to each other so as to place the ports and patterns in alignment. Surface patterns of the first type are adjacent to surface patterns of the second type on a plate adjacent thereto to form a plurality of opposing pattern pairs. Each of the first and second patterns in each pattern pair have a generally sinusoidally varying surface and means adapted to maintain the first and second patterns a predetermined distance from each other, whereby the second gas flows in a generally sinusoidal path of substantially constant cross sectional area but varying shape in a first direction and along a first side of the first and second patterns between the first and second patterns, and the first gas flows in a generally sinusoidal path of substantially constant cross sectional area but varying shape in a direction opposite the first direction along the other side of at least one of the first and second patterns.

BRIEF DESCRIPTION OF THE DRAWINGS

These and other objects, aspects and embodiments of the invention will be described in more detail below with reference to the following drawing figures of which.

DETAILED DESCRIPTION OF THE PREFERRED EMBODIMENTS

The plates which employ the primary surfaces in accordance with the present invention are disposed in a compact heat exchanger of the type generally illustrated in FIG. 5, which will be explained in more detail below. Generally, the heat exchanger illustrated in FIG. 5, and those discussed above, provide for the transfer of heat from a first gas to a second gas, the first gas being exhaust gas from an engine, the second gas being compressed air, in the example of FIG. 5. The details of the individual surface patterns will first be described with reference to FIGS. 1–4.

Figure 1A:
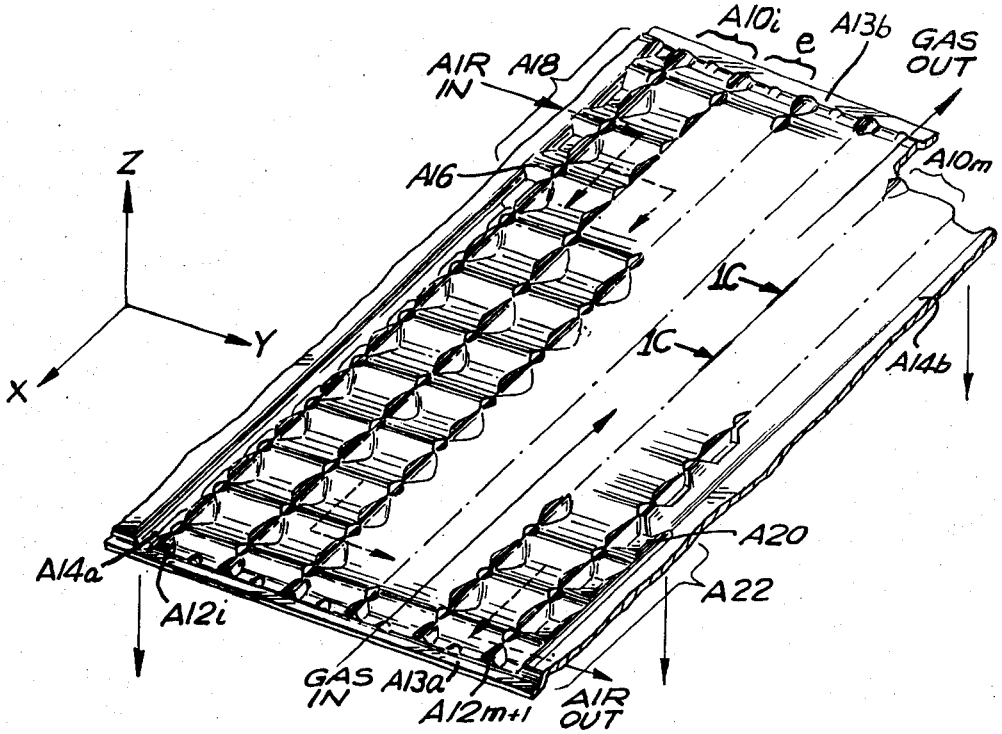
FIG. 1A is a detailed perspective view of the type A pattern employed on the plates disposed in the heat exchange apparatus in accordance with the present invention.
Figure 1B:
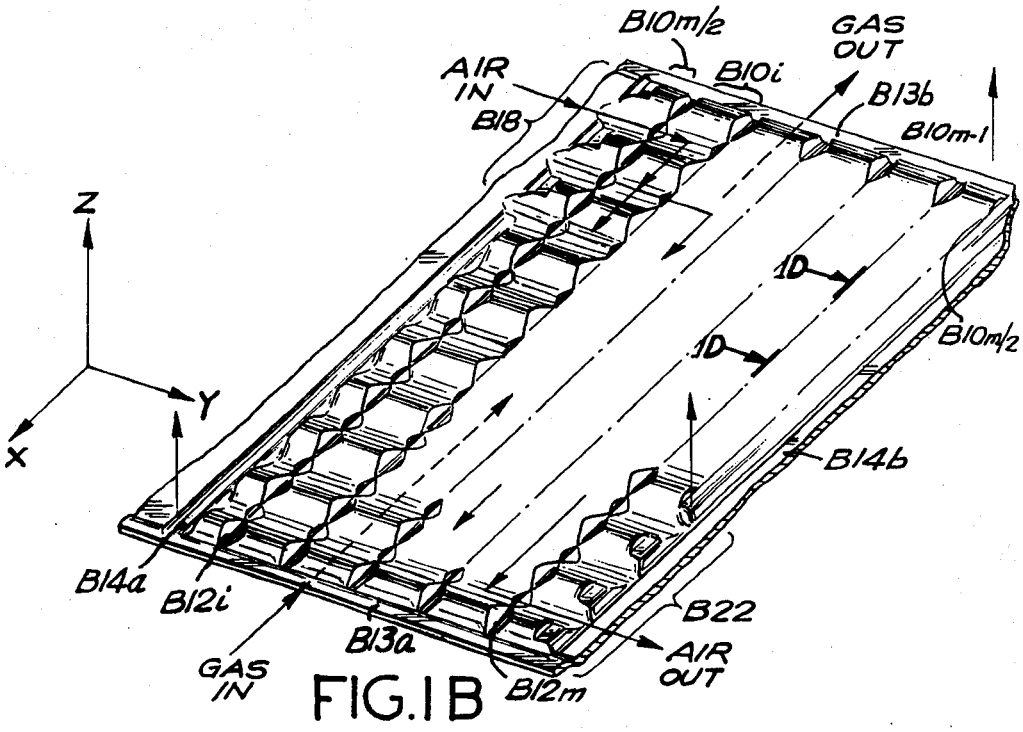
FIG. 1B is a detailed perspective view of the type B pattern employed on the plates used in the heat exchange apparatus in accordance with the present invention.

The primary surfaces for a compact heat exchanger are illustrated in FIGS. 1A and 1B. FIG. 1A illustrates what will be referred to as the primary surface pattern A, or the A pattern, while FIG. 1B illustrates what will be referred to as the primary surface pattern B, or the B pattern. The A pattern is generally rectangular and includes a plurality of strips A10i–A10m extending the length of the pattern along the X direction and having a width e in the Y direction. The vertical extent of each of the strips **A10*i*–A10*m*** in the Z direction varies approximately sinusoidally along the X direction, to provide generally sinusoidal paths of travel for the two gases, as will be explained in more detail below.

Disposed on either side of each of the strips A10*i*–A10 *m* and contiguous therewith are an associated plurality of spacing ridges A12 *i*–A12*m*+1. Disposed along the left and right edges of plate A in the X direction are sealing ridges A14*a* and A14*b*, respectively. Sealing ridge A14*a* is comprised of an indentation in a downward, or negative Z direction and extends from the front edge of the plate through the greater portion of the length of the plate to point A16, where a partial strip A18, is disposed to the left of primary ridge A12*i*. The discontinuation of the sealing ridge provides an air inlet below plate A at A18.

On the right-hand side of the A pattern, extending from the rear edge of the pattern to point A20, is sealing ridge A14*b* which provides an indentation in the downward, or negative Z direction. At point A20 however, sealing ridge A14*b* terminates, and a partial strip A22 is provided. The termination of the sealing ridge provides an air outlet below plate A at A22. Sealing ridges A14*a* and A14*b* are substantially identical in length, the only difference being that sealing ridge A14*a* begins at the front portion of the A pattern and terminates at point A16 in the proximity of the rear edge of the pattern, while sealing ridge A14*b* starts at the rear edge of the pattern and terminates at point A20 in the proximity of the front edge of the pattern. Finally, the A pattern is terminated front and back by sealing ridges A13*a* and A13*b*, respectively, both disposed in the same X-Y plane as sealing ridges A14*a* and A14*b*, the combination of sealing ridges A13*a*, A13*b*, A14*a* and A14*b* providing a border around the periphery of the pattern, except for air inlet A18 and air outlet A22.

With reference to FIG. 1B, the B pattern, which is essentially identical to the A pattern, except for the important differences noted below, is shown. In referring to the various portions of the B pattern, reference numerals identical to those used in discussing the A pattern will be used when referring to the associated portions of the B pattern, the prefixes "A" and "B" being used to designated the A or B patterns, respectively.

One of the major differences between the A and B patterns is that the B pattern is provided with full strips B10*i*–B10*m*−1, one less full strip than that contained in pattern A. The extra strip B10*m* is divided into two strips B10*m*/2 on either side of strips B10*i*–B10*m*−1, each of the strips B10*m*/2 being one-half the width of the strips B10*i*–B10*m*−1. As will be seen in greater detail below, this disposition of strips B10*m*/2 causes an interleaved pattern of ridges A12*i*–A12*m*+1 and B12*i*–B12*m*, when the A and B patterns are placed on top of each other when mounted in the compact heat exchanger.

Figure 1C:
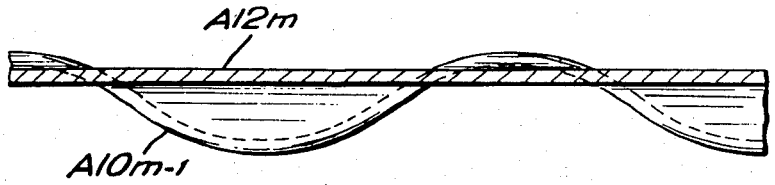
FIG. 1C is a cross-section view of the type A pattern taken through section 1C—1C in FIG. 1A.
Figure 1D:
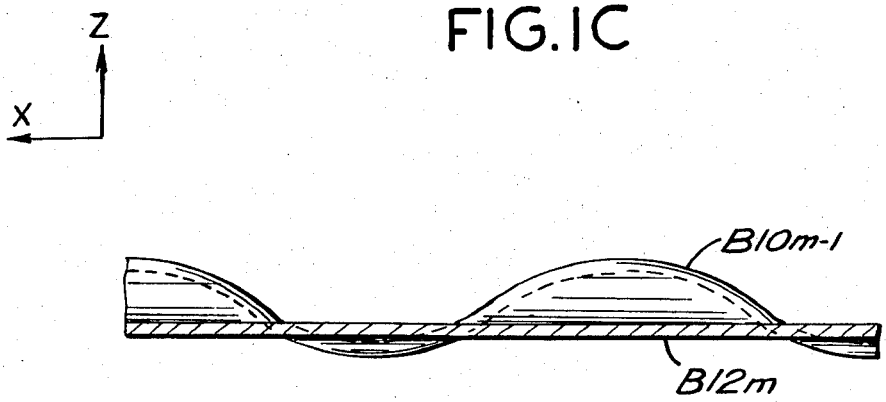
FIG. 1D is a cross-section view of the type B pattern taken through section 1D—1D of FIG. 1B.
Figure 3:
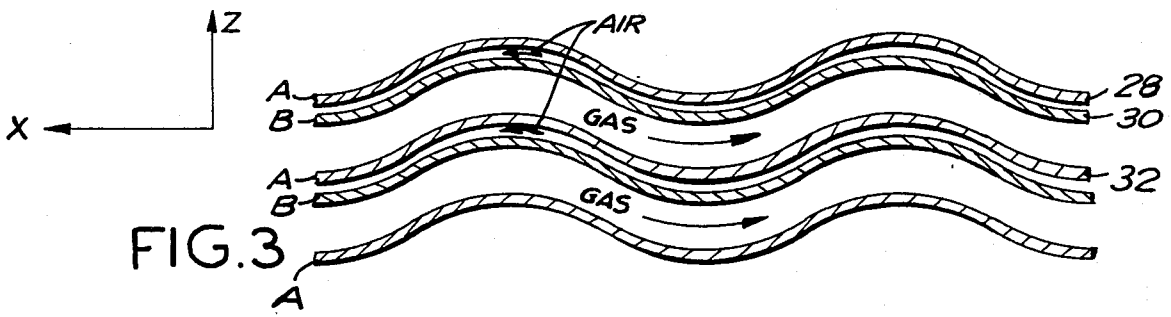
FIG. 3 is a cross-section view of a plurality of type A and B patterns in stacked relationship as disposed within the heat exchange apparatus in accordance with the present invention, taken through section 3—3 of FIG. 2.

Another major difference between the A and B patterns is the disposition of sealing ridges B13*a*, B13*b*, B14*a* and B14*b*, which provide upwardly extending protrusions, rather than the downwardly extending indentations as with pattern A. Pattern B is provided with air inlet B18 disposed in the same location along the left-hand edge of pattern B as that of air inlet A18 in pattern A. Similarly, pattern B is provided with air outlet B22 provided in the position corresponding to the associated air outlet A22 in pattern A. The generally sinusoidal variations in the Z direction along the X direction in strips A10*i*–A10*m* and B10*i*–B10*m* are essentially identical, and begin and end on the plates in the X direction such that the waves line up coherently, as best illustrated in FIG. 3, when the A and B patterns are placed adjacent to one another. The disposition in the Z direction of ridges A12*i*–A12*m*+1 relative to the sinusoidally varying paths in pattern A reflect the disposition in the Z direction of ridges B12*i*–B12*m* relative to the sinusoidally varying paths in pattern B. With reference to FIGS. 1C and 1D, illustrating the cross-section views taken through sections 1C—1C and 1D—1D, respectively, it can be seen that ridge A12*m* is positioned in the Z direction to be closer to the peaks of path A10*m*−1 than the valleys thereof, for example. This is in contrast to ridge B12*m*, which is positioned in the Z direction to be closer to the valleys of path B10*m*−1 than the peaks thereof. It should be noted that an inversion of one of the patterns of FIGS. 1C or 1D will produce the other of the patterns.

The A and B patterns illustrated in FIGS. 1A and 1B are adapted to be placed in abutting relationship when assembled in the heat exchanger. When so disposed, each of the four edges of patterns A and B will effectively be sealed together, by abutting pairs of sealing ridges 13*a*, 13*b*, 14*a*, 14*b*. Thus, the peripheries of the A and B patterns are effectively sealed except for those portions in which air inlets A18, B18 and A22 and B22 are disposed to provide respective air inlets and outlets to produce the air flow between the plates, as illustrated, from the air inlet to air outlet.

The A and B patterns shown in FIGS. 1A and 1B, effectively sealed about the edges except for the air inlet and air outlet, will hereinafter be referred to as a "pattern pair". When assembled in the heat exchanger, both on top of and on the bottom of the pattern pair shown in FIGS. 1A and 1B will be further pattern pairs. Adjacent pattern pairs are always disposed such that an A-B-A-B-A-B . . . sequence is always provided. The pattern pairs are stacked in abutting relationship, but the patterns from different pattern pairs will not be sealed about their peripheries since the sealing ridges between different pattern pairs are directed away from each other, thus allowing a gas flow in the X direction between adjacent pattern pairs, as shown in FIGS. 1A and 1B as a gas flow both above and below the pattern pair. The air flow and gas flow through the stack of plates will be described in greater detail below.

Figure 2:
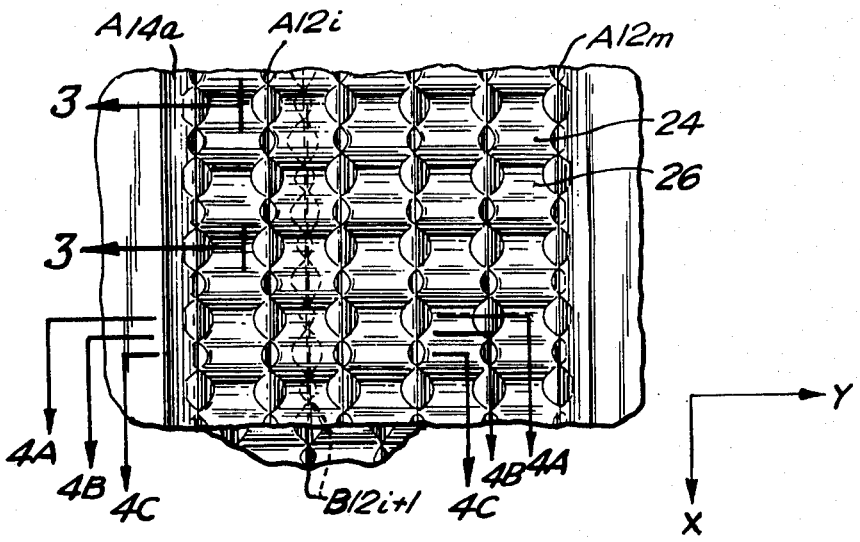
FIG. 2 is a top view of the type A pattern of FIG. 1A.

FIG. 2 is a top view of the pattern pair illustrated in FIGS. 1A and 1B. Shown therein is sealing ridge A14*a*, and spacing ridges A12*i*–A12*m*. Shown in dashed lines is ridge B12*i*+1 to illustrate the relationship between ridges on the A and B patterns. Also designated are "hills" 24 and "valleys" 26 along the sinusoidally varying strips A10*i*–A10*m* and the underlying strips B10*i*–B10*m*. Typical dimensions of the patterns may, for example, be approximately 0.362 inches between spacing ridges, approximately 0.330 inches in the X direction for a single sinusoidal cycle of the sinusoidal paths, and approximately 0.058 inches peak-to-peak along the Z direction for each path. The typical thickness of the plates on which the patterns are provided is approximately 0.008 inches. Many variations to the above dimensions will become apparent to those skilled in the art to produce slightly different effects as desired.

Section 3—3 of FIG. 2, taken along the X axis between spacing ridges A12*i* and B12*i*+1, is illustrated in FIG. 3. It can be seen that A pattern 28 and adjacent B pattern 30 provide a pattern pair since an air flow is established therebetween. Also shown is a pattern 32 from an adjacent pattern pair, which is in abutting relationship with B pattern 30. A gas path is provided as shown in the space between patterns 30 and 32.

Figure 4A:
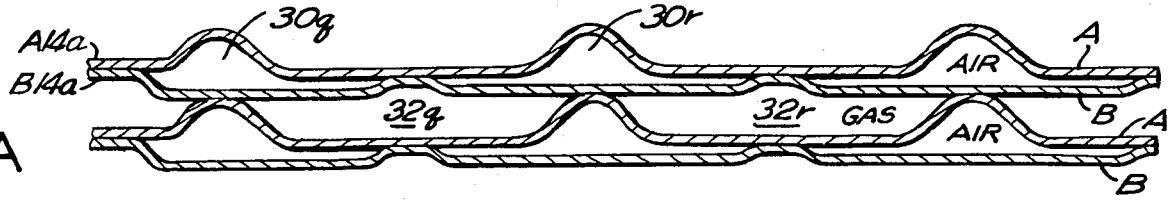
FIGS. 4A–4C are cross-section views of a plurality of type A and B patterns in stacked relationship and disposed in the heat exchange apparatus in accordance with the present invention, taken through section 4A—4A through 4C—4C, respectively.
Figure 4B:
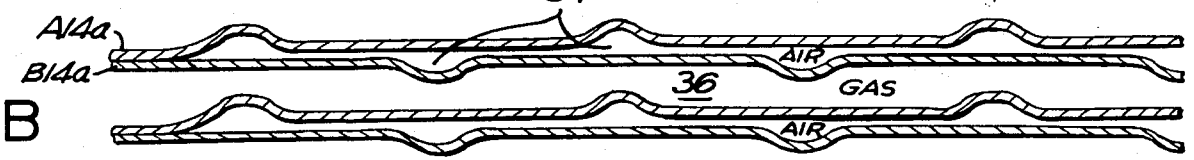
Figure 4C:
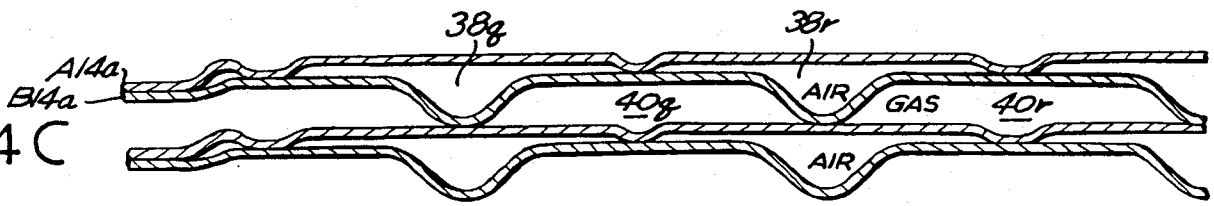

The sections 4A—4A, 4B—4B and 4C—4C, of FIG. 2, are illustrated in FIGS. 4A-4C, respectively. Section 4A—4A, taken through the nadir of one of the valleys 26, is shown in FIG. 4A. At the left-most portion of FIG. 4 it can be seen that sealing ridges A14*a* and B14*a* on the top pattern pair come into abuttment to seal the periphery of each pattern pair. Air which enters at the air inlet as shown in FIGS. 1A and 1B will occupy the air passageway 30 while gas occupys passageway 32.

At section 4A the airflow passage is split by spacing ridges B12*i* into channels 30*q*, 30*r* etc., and the gas passage 32 is split by spacing ridges A12*i* into channels 32*q*, 32*r*, etc. Section 4B—4B taken vertically through the series of plates at a location slightly closer toward the front of the plates than section 4A—4A is illustrated in FIG. 4B. Air passage 34 on FIG. 4B is the continuation of air passage 30 of FIG. 4A, and gas passage 36 on FIG. 4B is the continuation of gas passage 32 of FIG. 4A. Section 4C—4C taken through the highest point of the hill portions of the paths produces the situation illustrated in FIG. 4C. At section 4C the air-flow passage is split by spacing ridges A12*i* into channels 38*q*, 38*r*, etc., and the gas passage is split by spacing ridges B12*i* into channels 40*q*, 40*r*, etc. It will be appreciated that sections through the air and gas passageways, perpendicular to the direction of flow exhibit large variations in shape and small variations in area along the direction of flow. It should also be appreciated that each of the air and gas paths are continuous in the X direction and vary sinusoidally in the Z direction, as illustrated in FIG. 3, to thus provide parallel, sinusoidal air and gas flows in opposite directions, in order to produce the air flow from the air inlet to the air outlet between A and B patterns in a pattern pair as shown in FIGS. 1A and 1B, and the gas flow between different pattern pairs.

Thus, the strips A10*i*–A10*m* on the A plate are separated from the strips B10*i*–B10*m* on the B plate by the spacing ridges on each of the plates which function to form a grid of touching points between the plates as best illustrated in FIGS. 4A and 4C. An important difference between the present invention and that of the above-mentioned patent to Stein et al. is that the present invention provides essentially constant area flow passages through which gas or air flows in a cyclically or generally sinusoidal path established by the shape of the strips and modified by the spacing ridges. The shape of the strips superficially resembles a sine wave, and for brevity, the strips are referred to as being generally sinusoidal. However, it is to be understood that neither the plate shape nor the gas or air paths are truly sinusoidal, nor would any special merit attend the use of a sine wave. When the A and B plates are placed together to form flow passages, the spacing ridges from each plate slice into the flow passage at points of nearest approach of the opposing plate. In both the air and gas passages, as the fluid moves between the plates it encounters an array or grid of spacing ridges which present themselves to the fluid stream as intermittent streamlined projections. The staggered or intermittent grid of projections acts to produce secondary flows which promote thermal mixing, thus enhancing the rate of heat transfer.

This is contrasted with the Stein et al. patterns which exhibit a significant degree of expansion and contraction of the flow passages at each transverse ridge to promote thermal mixing within the flow passages. The present invention thus provides a lower pressure drop due to less variation in the cross-section area of the flow paths. Also, heat transfer is higher because the cross-section, although of substantially constant area, is constantly changing shape to thus produce secondary flows which enhance the coefficient of surface heat transfer. Further, the approximately sinusoidal flows will also increase heat transfer.

The flow passages just described provide a significant advance over the associated flows in the prior art heat exchangers, since:

(1) Pressure drop is lower because cross-section area variation is less;

(2) Heat transfer is higher because cross-section shape is constantly changing producing secondary flows which enhance the coefficient of surface heat transfer; and (3) The turning of the flow by the approximately sinusoidal shape will also increase the heat transfer.

As a result, the stack produced using the above described patterns as more fully described below would exhibit a lower pressure drop across the patterns and an increased heat transfer.

The technique employed in accordance with the present invention for utilizing the above described combination of A and B patterns will now be described with further reference to FIGS. 5 and 6. Illustrated in FIG. 5 is the overall configuration of the stack provided in the heat exchanger in accordance with the present invention, the stack being similar to that disclosed in the co-pending U.S. patent application Ser. No. 312,309. All of the A and B patterns discussed above have an overlying relationship with each other corresponding to the stack of A-B-A-B . . . patterns illustrated at 100, FIG. 5. Each of the patterns is disposed on an even or odd plate, 102–107, plates 102, 104 and 106 being even plates, plates 103, 105 and 107 being odd plates. One even and one odd plate comprise a plate pair sealed along the inner and outer peripheries 110,112, respectively, thereof, each of the abutting A and B patterns on the plate pairs forming the above described A and B pattern pairs. More specifically, A pattern A102 on plate 102 and B pattern B103 form a pattern pair identical to that shown in FIGS. 1A and 1B, thus providing the air path between patterns A102 and B103 as illustrated in detail in FIGS. 1A and 1B. Similar pattern pairs are provided between underlying patterns A104–B105, A106–B107, and so on, as well as between patterns in other portions of the plate pairs, such as between patterns B102–A103, and so on, as explained in more detail below. Between each of the plate pairs, and the associated pattern pairs, such as between patterns B103 and A104, a radial gas path is provided as indicated in the figure, and as illustrated in detail in FIGS. 1A and 1B.

Each of the plates 102, 103 . . . , are generally flat, circular and provided with a large circular inlet 114 through which hot gas may enter the stack. Typical dimensions of the plates are approximately 39 inches in outer diameter and 26.6 inches in inner diameter, variations in such dimensions for any particular purpose being within the skill of the art. Each of the plates is provided with a series of the A-B-A-B . . . patterns about the circumference thereof, a total of approximately 15 A and 15 B patterns being provided on each plate. Between each of the A and B patterns are air ports 115, 116, 117, 118, etc., the even numbered ports 116, 118 . . . , being air input ports, the odd numbered ports 115, 117 . . . , being air output ports.

In operation, a hot gas, such as that from the exhaust of a turbine engine, is forced into duct 114 in the center of the stack. The hot gas escapes radially from the stack through the paths provided between adjacent plate pairs. Cooler air, such as that provided from the compressor of such a turbine engine, is forced into the input ports 116, 118 . . . , and travels within each of the plate pairs, between an A and B pattern, to adjacent output ports 115, 117 . . . , where the air is recovered and provided to the combustion portion of the turbine. In doing so, a substantial amount of the heat in the exhaust gas is transferred to the air by way of the thin metallic plates 102, 103, etc.

Figure 5:
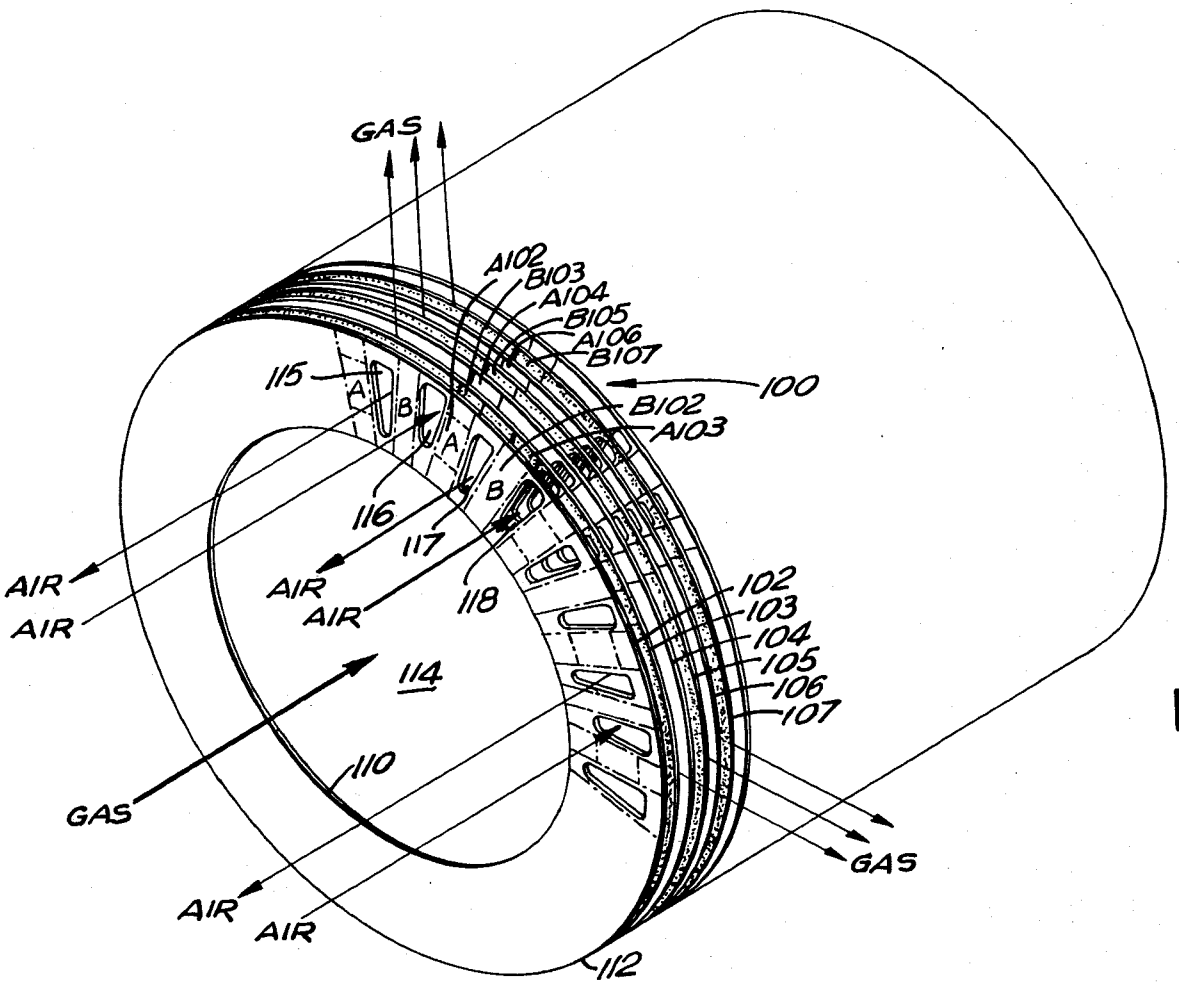
FIG. 5 is a perspective view of the plurality of plates each having an alternating array of type A and type B patterns, the plates being stacked in accordance with the present invention.
Figure 6:
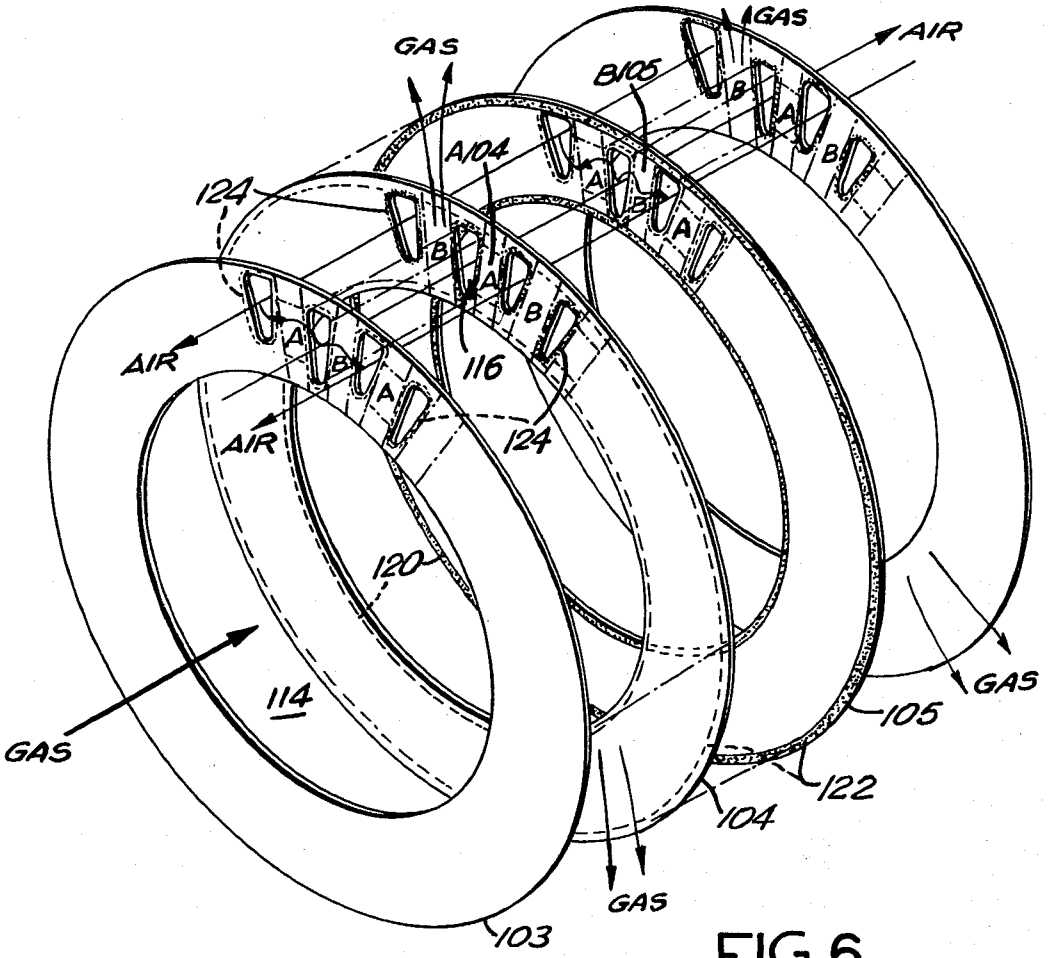
FIG. 6 is an exploded view of a portion of the heat exchange apparatus illustrated in FIG. 5 showing in detail the various gas flows produced in accordance with the present invention.

Still referring referring to FIG. 5, and with further reference to FIGS. 1A and 1B, each of the plates 102, 103 . . . may be made exactly alike by providing the series of alternating A and B patterns on each of the plates. When this is done, it is necessary to reverse the B pattern illustrated in FIG. 1B on all even plates, and to reverse the A pattern shown in FIG. 1A on all odd plates, such that the sealing ridges A13*a*, A13*b*, B13*a*, B13*b*, A14*a*, A14*b*, B14*a* and B14*b* on the even plates extend toward the associated sealing ridges on the odd plates. More specifically, B pattern B102 on plate 102, FIG. 5, is exactly the same as the B pattern shown in FIG. 1B when the B pattern shown in FIG. 1B is flipped over bottom side up in order to point the sealing ridges toward pattern A103, FIG. 5. Similarly, pattern A103, adjacent to pattern B102 is also the same as the A pattern illustrated in FIG. 1A when such pattern is flipped over so that the sealing ridges point toward pattern B102. In this manner, all of the pattern pairs on each plate pair are sealed about their peripheries (except for the air inlets and outlets). It can now be appreciated that each of the even and odd plates are exactly alike, the only difference being that an odd plate is diametrically rotated 180 degrees relative to an even plate. Alternate sides face forward within the stack as shown in FIG. 5.

The detailed air and gas flows will now be described with reference to FIG. 6 which shows an exploded view of four of the plates in the stack. Plates 104 and 105 form a plate pair as described above. Plate 103 forms a plate pair with plate 102 which is not shown in FIG. 6 for purposes of clarity. As mentioned above, all of the plates are all provided in abutting relationship to form the stack, the inner and outer circumferences of the plates which form a plate pair, such as plates 104 and 105, are welded together as functionally shown by welds 120 and 122. On the other hand, adjacent plates belonging to different plate pairs, such as plates 103 and 104, are welded about the periphery of each of the air input and output ports, as functionally shown by welds 124. The hot exhaust gas entering duct 114 can only be radially expelled from the stack between the plate pairs as illustrated in FIGS. 5 and 6, since the input and output ports 115, 116, etc., are isolated from the gas by welds 120, 122 and 124. The air applied to the input ports, on the other hand, can exit the stack only through the paths provided between the A and B patterns in each of the plate pairs. For example, air going into the stack through port 116 can exit the stack by travelling between patterns A104 and B105 which have a relationship identical to that illustrated by patterns A and B in FIGS. 1A and 1B, respectively. The air from port 116 enters the air inlet between the patterns and exits the air outlet whereupon it merges with the outcoming air similarly provided from downstream plate pairs. In making such a traverse, the air is significantly heated from the energy supplied from the hot exhaust gas through the thickness of the individual plates.

Thus, the plates produced in accordance with the present invention are readily manufactured since the even and odd plates are identical, thus requiring only one die. The simplicity of such an arrangement also facilitates the construction of such a stack. Although this is the preferred technique, it will be appreciated that each of the plates may be provided exclusively with type A or type B patterns, as described in co-pending U.S. patent application Ser. No. 409,426, filed Aug. 19, 1982 and assigned to the assignee of the present invention, the type A and type B patterns being oriented so as to provide the pattern pairs described above. However, such an organization requires the use of two different types of plates, namely those having the A patterns and those having the B patterns thereon, thus requiring the use of two dies to fabricate the stack.

While the preferred embodiments and examples of the invention have been described with reference to the foregoing specification and drawings, the scope of the invention shall now be defined with reference to the following claims.

What is claimed is:

1. A heat exchange apparatus made up of a plurality of plates formed and stacked as to provide heat transfer through said plates from a first gas to a second gas, said plates being of substantially identical configuration and size, each of said plates formed with a central opening and an alternating arrangement of first and second surface patterns, and ports provided between said first and second surface patterns, said plates being stacked such that adjacent plates are rotated 180° about a diametrical axis relative to each other and so as to place said ports and patterns in alignment, surface patterns of the first type from any of said plates being adjacent to surface patterns of the second type on a plate adjacent thereto to form a plurality of abutting and opposing pattern pairs, each of said first and second patterns in each pattern pair having a plurality of generally sinusoidally varying surface strips aligned in a generally radial direction with respect to said central opening and a plurality of spacing ridges between said surface strips and generally parallel thereto, whereby said second gas flows in a generally sinusoidal path in a first generally radial direction along a first side of said first and second plates between said first and second plates and said first gas flows in a generally sinusoidal path in a generally radial direction opposite said first generally radial direction along the other side of at least one of said first and second plates.

2. The heat exchange apparatus of claim 1 wherein said plurality of spacing ridges on said second pattern in each pattern pair are disposed relative to said plurality of spacing ridges on said first pattern such that said plurality of spacing ridges on said second pattern lie along a line substantially along the middle of said plurality of surface strips of said first pattern, and said plurality of spacing ridges on said first pattern lie along a line substantially in the middle of said surface strips of said second pattern.

3. The heat exchange apparatus of claim 2 wherein said first and second patterns in each pattern pair are each provided with first and second sealing ridges disposed on opposite sides of said plurality of surface strips and substantially parallel to said spacing ridges, said first ealing ridges extending from one end of each of said first and second patterns and terminating short of the other end of said first and second patterns to provide an inlet for said second gas, said second sealing ridges extending from the other end of said first and second patterns and terminating short of said one end of said first and second patterns to provide an outlet for said second gas, said first and second sealing ridges on said first pattern abutting said first and second sealing ridges on said second pattern, respectively, said second gas flowing from said inlet to said outlet between said first and second patterns.

4. The heat exchange apparatus of claim 3, wherein said first and second patterns in each pattern pair each further comprise third and fourth sealing ridges disposed on opposite ends of said plurality of surface strips substantially perpendicular to said spacing ridges.

5. A heat exchange apparatus made up of a plurality of plates formed and stacked as to provide heat transfer through said plates from a first gas to a second gas, said plates being of substantially identical configuration and size, each of said plates formed with a central opening and an alternating arrangement of first and second surface patterns, and ports provided between said first and second surface patterns, said plates being stacked such that adjacent plates are rotated 180° about a diametrical axis relative to each other and so as to place said ports and patterns in alignment, surface patterns of the first type from any of said plates being adjacent to surface patterns of the second type on a plate adjacent thereto to form a plurality of abutting and opposing pattern pairs, each of said first and second patterns in each pattern pair having a plurality of generally radially aligned and sinusoidally varying surface strips and a grid of support points adapted to maintain said first and second patterns a predetermined distance from each other, whereby said second gas flows in a generally sinusoidal path in a first generally radial direction along a first side of said first and second patterns between said first and second patterns and said first gas flows in generally sinusoidal path in a generally radial direction opposite said first direction along the other side of at least one of said first and second patterns.

6. A heat exchange apparatus made up of a plurality of plates formed and stacked as to provide heat transfer through said plates from a first gas to a second gas, said plates being of substantially identical configuration and size, each of said plates formed with a central opening and an alternating arrangement of first and second surface patterns, and ports provided between said first and second surface patterns, said plates being stacked such that adjacent plates are rotated 180° about a diametrical axis relative to each other and so as to place said ports and patterns in alignment, surface patterns of the first type from any of said plates being adjacent to surface patterns of the second type on a plate adjacent thereto to form a plurality of opposing pattern pairs, each of said first and second patterns in each pattern pair having a plurality of generally radially aligned and generally sinusoidally varying surface strips and means adapted to maintain said first and second patterns a predetermined distance from each other whereby said second gas flows in a generally sinusoidal path of substantially constant cross-sectional area but varying shape in a first generally radial direction along a first side of said first and second patterns between said first and second patterns and said first gas flows in a generally sinusoidal path of substantially constant cross-sectional area but varying shape in a generally radial direction opposite said first direction along the other side of at least one of said first and second patterns.

* * * * *